US005582491A

United States Patent [19]

Pardue, Sr.

[11] Patent Number: 5,582,491

[45] Date of Patent: Dec. 10, 1996

[54] SYSTEM TO INCREASE THE TENSION CAPACITY OF PIPE PILES DRIVEN INTO THE OCEAN FLOOR

[76] Inventor: James H. Pardue, Sr., 339 Tara Trail, Atlanta, Ga. 30327

[21] Appl. No.: 516,475

[22] Filed: Aug. 17, 1995

[51] Int. Cl.[6] ..... E02D 7/20; E02D 7/28

[52] U.S. Cl. ..... 405/224; 405/225

[58] Field of Search ..... 405/228, 224, 405/195.1, 203, 204, 232, 223.1, 224.1, 225; 114/294, 295, 296

[56] References Cited

U.S. PATENT DOCUMENTS

| | | | |
|---|---|---|---|
| 2,994,202 | 8/1961 | Knapp et al. | 405/224 |
| 3,817,040 | 6/1974 | Stevens | 405/228 |
| 4,257,721 | 3/1981 | Haynes | 405/228 X |
| 4,575,282 | 3/1986 | Pardue, Sr. et al. | 405/228 |

*Primary Examiner*—Stephen J. Novosad

[57] ABSTRACT

A new pile assembly and process are disclosed. A pile cap is attached to a pipe pile. A partition is installed below the pile cap creating an air chamber between them that is at surface atmospheric air pressure. An external conduit containing a valve that is closed connects the pile's interiors above and below the partition. The pile is driven into the ocean floor filled with entrapped sea water below the partition so that little or no soil core is generated. After the clay soils adjacent to the pile have regained their strength, the valve is opened. A small amount of sea water expands into the air chamber. The pressure on both sides of the partition and the bottom of the pile cap is now slightly above surface atmospheric air pressure. It is the downward force of hydrostatic pressure on top of the pile cap that increases the tension capacity of the driven pile. In deep water hydrostatic pressure is substantial, constant and cheap.

23 Claims, 7 Drawing Sheets

SYSTEM TO INCREASE THE TENSION CAPACITY OF PIPE PILES DRIVEN INTO THE OCEAN FLOOR

BACKGROUND

1. Field of Invention

The present invention relates to a process for increasing the tension capacity of pipe piles that have been driven or drilled and grouted into the ocean floor. It also relates to apparatus for carrying out this process.

The offshore oil and gas industry is slowly moving into deeper water where their exploration and production platforms will not stand on top of rigid structures. They will float and be held in place by anchor cables or tendons attached to piling driven into the ocean floor. These driven or drilled and grouted pipe piles will be required to have large tension capacities. A piling failure by pullout during a hurricane and a dislodged production platform could result in an uncontrolled flowing oil well on the ocean floor. The process and pile assembly presented hereafter provides a new economical way to substantially increase the tension capacity of pipe piles driven into the ocean floor in deep water.

2. Description of the Prior Art

U.S. Pat. No. 4,575,282 to Pardue, Sr. et al. (1986) discloses a method of driving open end pipe piles into the ocean floor in deep water. The process uses compressed air from the ocean surface to evacuate sea water and drilling mud from the pipe pile through a one-way ball check valve and then vents the compressed air to the atmosphere. Hydrostatic pressure at depth then drives the pile.

SUMMARY OF THE INVENTION

The present invention increases the tension capacity of a pipe pile that has been driven or drilled and grouted into the ocean floor in deep water by creating an air chamber under the pile cap. This air chamber has an internal pressure that is at or near surface atmospheric air pressure. This air chamber is created by installing a partition in the top portion of the pipe pile below the pile cap. An exterior pipe or conduit containing a connecting valve connects the pile interiors above and below the partition. This conduit also contains an exhaust valve below the connecting valve leading to the surrounding sea water. Before the pipe pile is transported from the pile fabrication yard, both valves are closed. At the installation site after the pile is upended and the pile cap is just below the ocean surface, the exhaust valve is manually opened and air that was trapped below the partition is expelled by incoming sea water that rises within the pipe pile. After all of this trapped air has been expelled, the exhaust valve is closed by the diver while the top of the pile is just below the ocean surface.

The pile is then lowered to the ocean floor and driven. The expensive rented marine vessels with their pile driving equipment are returned to shore. Next, there will be a waiting period during which the disturbed and remolded clay soils adjacent to the pile's exterior are given time to set-up and regain their full shear strength. After the waiting period is over, the connecting valve is opened by a tethered remote operating vehicle. The pressure on the bottom of the partition which had counterbalanced the local hydrostatic pressure on top of the pile cap is now slightly above surface atmospheric pressure. Water is slightly compressible, so a small amount of sea water from below the partition has expanded up through the conduit and into the air chamber relieving pressure on the bottom of the partition. The pressure within the air chamber under the pile cap is now slightly above surface atmospheric air pressure. No additional sea water can enter the pile because the exhaust valve is closed and the pile has been driven into stiff impermeable clay. When the pile was driven, it was filled with sea water below the partition which could not be expelled because both valves were closed. Therefore, no significant soil core was generated within the pipe pile during pile driving. The tension capacity of the pile has been increased by the local hydrostatic pressure on top of the pile cap.

This increased tension capacity can be significant for pipe piles driven in deep water. A pile of this design with an inside diameter of 6 feet, 6 inches driven into the ocean floor at a depth of 3,000 feet could have an added tension capacity of approximately 3,000 tons.

Using the above example, assume that a small tension leg platform is to be installed where the ocean is 3,000 feet deep. Its design including a factor of safety specifies a total of 72,000 tons of pile tension capacity. This could be accomplished using twelve ordinary pipe piles driven to a depth resulting in 6,000 tons of tension capacity for each pile. The same 72,000 tons of pile tension capacity can also be obtained by driving only eight piles of the present invention that have the same dimensions and penetration as the above twelve ordinary pipe piles. These eight modified pipe piles would each have a tension capacity of 9,000 tons (6,000 tons plus 3,000 tons of added tension capacity). That would be a cost-savings of approximately thirty-three percent in a major cost category—underwater pile driving in deep water. A similar analysis can be applied to other proposed tension pile configurations.

The advantages of this process and pile assembly are:

1. It is definitely low technology.
2. Other than the pile's anchor cable, there are no connections to maintain between the pile and the ocean surface.
3. The only moving parts are two valves.

This system would not have an application with piles driven into permeable soils and the results would be uneconomical in shallow water. Its use would probably be in water depths of 1,500 feet and deeper.

DETAILED DESCRIPTION OF THE INVENTION

Driving pile foundation into the ocean floor to anchor offshore floating oil and gas platforms is expensive. In deep water, it is very expensive. The invention presented herein takes advantage of the large hydrostatic pressure found in deep water near the ocean floor to inexpensively increase the tension capacity of these anchor piles. Using simple pipe pile fabrication additions, this is accomplished by replacing the local hydrostatic pressure on the bottom of the pile cap of the driven pile with a pressure that is slightly above surface atmospheric air pressure.

There are two factors that make this process possible. The relevance of each will be explained as the description of this process unfolds. First, there are clays that exist below deeper waters offshore that are essentially impermeable to the flow of ground water even under large hydrostatic heads of pressure. And second, water is almost incompressible and expands very little when it is relieved of considerable compressive stress.

Figure 1:
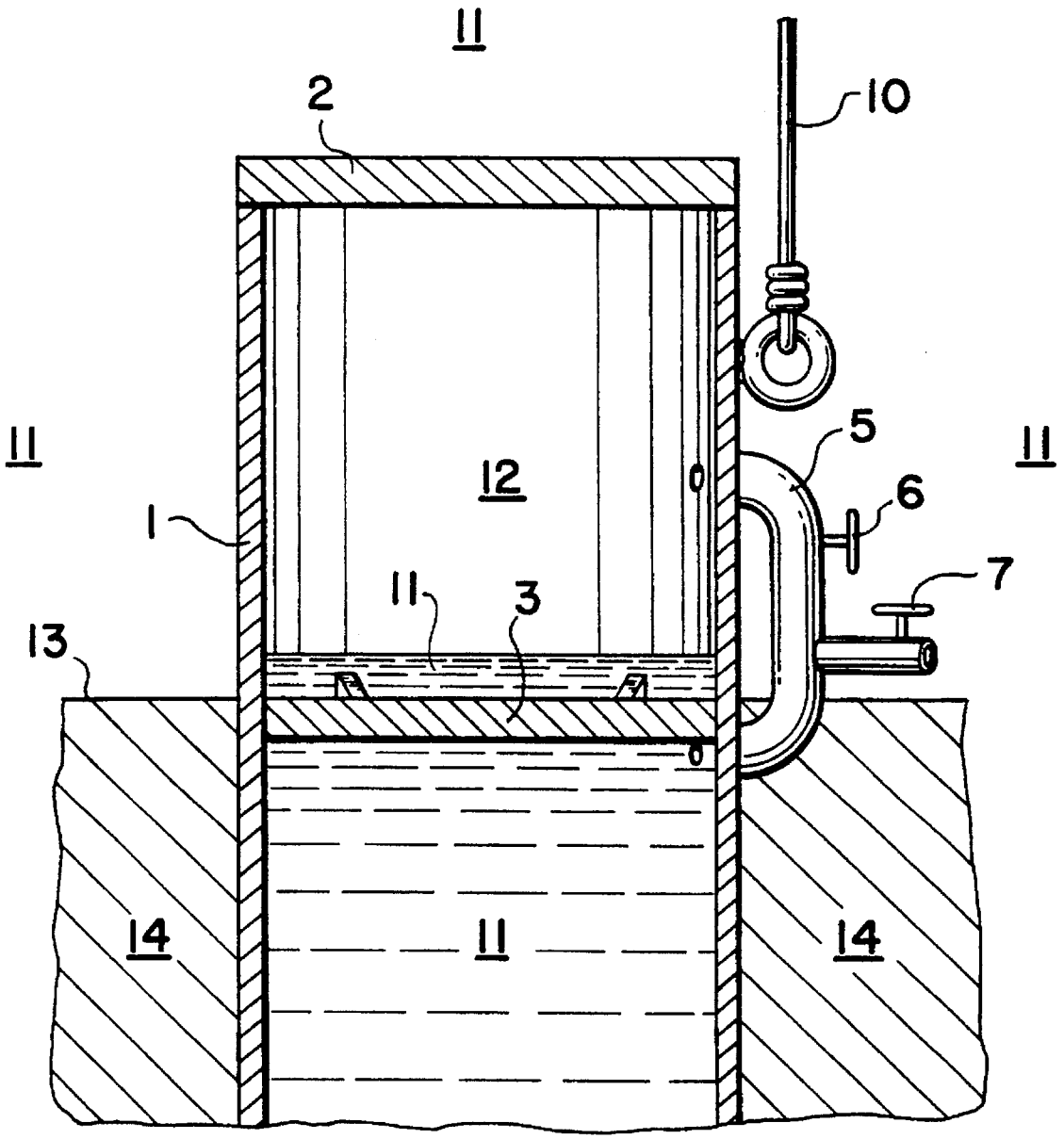
FIG. 1 is a fragmentary, vertical, sectional view, partly in elevation of the upper portion of a pile assembly of the present invention that has been driven into the ocean floor.

Anchor piles for offshore structures are huge pipe piles with pile caps. These piles are produced in a coastal steel fabrication yard. As shown in FIG. 1, the pile assembly of the present invention is provided with a fixed partition 3 located in the upper portion of the pipe pile 1. This creates an air chamber 12 beneath the pile cap 2. The pile assembly is also provided with a pipe or conduit 5 connecting the pile's interiors on both sides of the partition 3. This external conduit 5 contains a connecting valve 6 that is closed at the pile fabrication yard. It will remain closed isolating the air chamber 12 at surface atmospheric pressure until some time after the pipe pile 1 has been driven into the deep ocean floor 13. The conduit 5 could be internal as long as control of the connecting valve 6 is outside of the pile.

Below the connecting valve 6 is an exhaust valve 7 which also is closed at the pile fabrication yard. This exhaust valve 7 could be independent of the conduit 5 as long as the entrance to the exhaust valve 7 through the pile wall is just below the partition 3.

Offshore floating structures require many anchor piles. This process will follow one such pile out of the pile fabrication yard. The completed pipe pile assembly is transported or floated to a point above the installation site on the ocean floor. After the pile is upended to the vertical position and with the pile cap 2 just below the ocean surface, the exhaust valve 7 is opened by a diver. Sea water 11 rises within the pipe pile 1 and pushes air trapped beneath the partition 3 out through the open exhaust valve 7. This trapped air must be expelled from within the pile or this process will not work properly. After this trapped air is expelled, the diver closes the exhaust valve 7 and the pile assembly is lowered to the ocean floor and driven.

After the marine pile driving vessels are sent back to shore, the first step in increasing the tension capacity of the driven pile is to wait for a period of time. When a pile is driven through clay soils 14, it disturbs, remolds and weakens the clay soils 14 adjacent to the pile. These clay soils 14 will regain their full shear strength over time as excess pore water pressure within the clay soils 14 is dissipated. This process imparts a downward vertical force to the top of the pile cap 2. If this force is applied right after pile installation, it could push the pile cap 2 below its design elevation. If the pile is drilled and grouted in place, the waiting period could be much shorter. This waiting period should be no problem. Foundation piles for offshore floating platforms are normally driven many months to a year before the floating platform arrives on site.

After the waiting period, the duration of which is best determined by a geotechnical engineer, the second step in this process is to have a tethered remote operating vehicle open the connecting valve 6. No additional sea water can enter the pile because the exhaust valve 7 is closed and the pile has been driven into stiff clay that is essentially impermeable to the flow of ground water. Examples of such clays are the normally and over consolidated montmorillonite clays found in the deeper waters of the Gulf of Mexico below a penetration depth of approximately two hundred feet.

Figure 6:
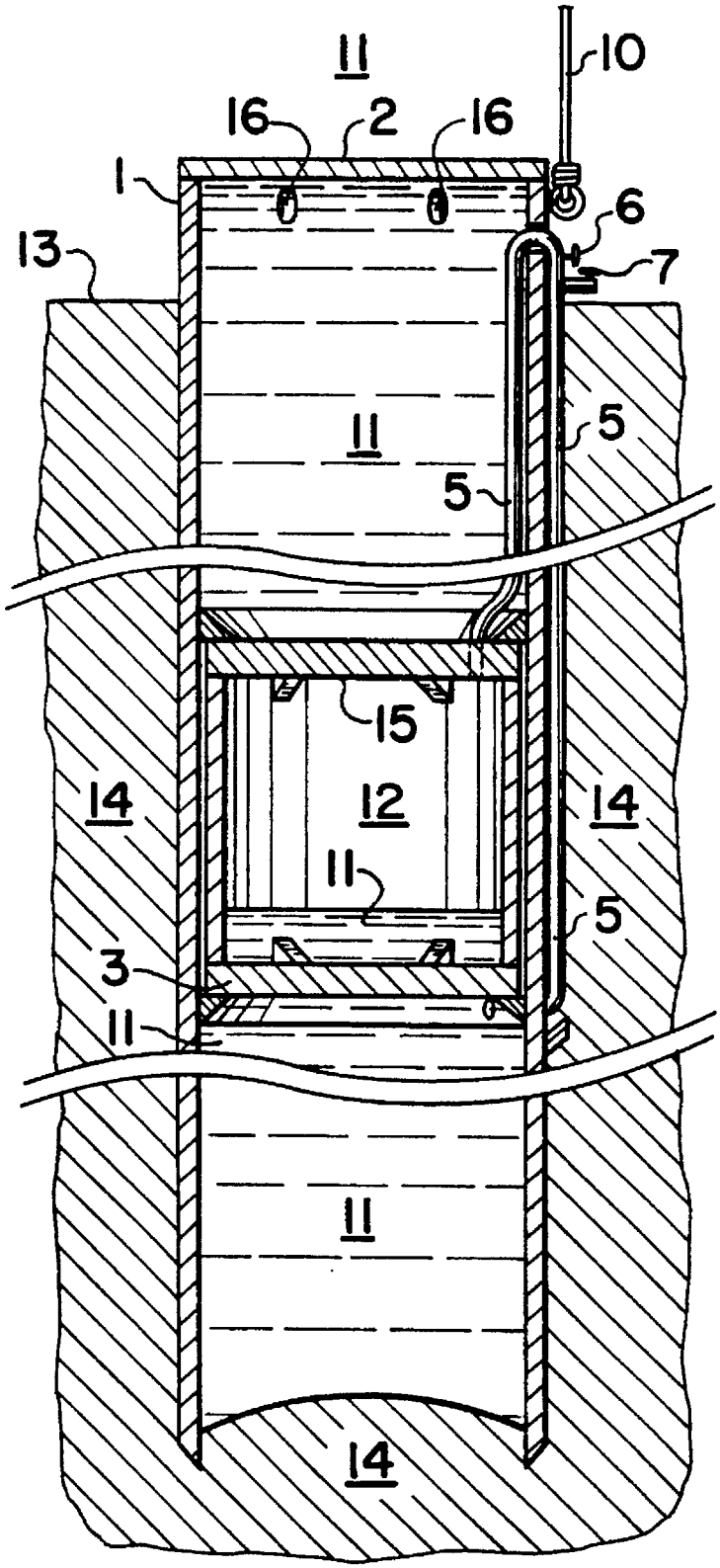
FIG. 6 is a fragmentary, vertical, sectional view, partly in elevation of a second alternate fabrication method of the pile assembly.

As the connecting valve 6 is opened, a small amount of sea water 11 from below the partition 3 immediately begins to expand through the conduit 5. This sea water 11 ends up on the floor of the air chamber 12 which is the top of the partition 3 as shown in FIG. 1. Also, the pore water in the clay soil directly below the bottom end of the pipe pile expands that clay soil which bulges up into the interior of the bottom of the pipe pile as shown in FIG. 6 and pushes a little more sea water 11 into the air chamber 12. Because the pile was filled with water below the partition, there is little or no soil core to push against. Therefore, there is no upward force applied to the interior walls of the bottom of the pipe pile. If the pile is drilled and grouted into place, care should be taken that no immobile grout core solidifies within the bottom of the pipe pile.

When the connecting valve 6 is opened, that part of the pipe pile just below the partition 3 becomes compressed by the hydrostatic pressure on top of the pile cap 2. This can be confirmed by strain gauges attached to the outside of the pile just below the partition. Also, before the tethered remote operating vehicle opens the connecting valve 6, it could attach a stethoscopic or listening device to the conduit 5. As the connecting valve 6 is opened, the sound of running water could be heard through the tether at the ocean surface. When the sound of running water stops, the pressure on the bottom of the partition 3 has been relieved.

Before the connecting valve 6 was opened, the hydrostatic pressure on top of the pile cap 2 was counterbalanced by the pressure on the bottom of the partition 3. Now with the connecting valve 6 open, the pressure on both sides of the partition 3 and the bottom of the pile cap 2 is only slightly above surface atmospheric pressure. But, the pressure on top of the pile cap 2 is the local hydrostatic pressure. The driven pipe pile 1 does not move because during the waiting period, the clay soils 14 adjacent to the pile have set-up and regained their full shear strength. The downward hydrostatic force on top of the pile cap 2 is now more than counterbalanced by the tight grip of the horizontally applied frictional resistance of the full shear strength of the clay soils 14 against the outside of the pile. The upward pull of the pile's anchor cable 10 must now exceed the hydrostatic pressure's downward force on top of the pile cap 2 before any upward stress is applied to the clay soils 14 adjacent to the pile. The tension capacity of the driven pile has therefore been increased by an amount approximately equal to the hydrostatic pressure on top of the pile cap 2. The preceding is the preferred embodiment of this invention because of its simplicity.

This process will work without an exhaust valve 7, but the mandatory removal of the air trapped below the partition 3 when the pile is upended at the ocean surface could be difficult requiring the manipulation of a very large steel tube just below the ocean surface to get rid of the trapped air.

It should be noted that when a driven pile's tension capacity has been increased using this process, its bearing capacity is correspondingly reduced. But bearing capacity is of little value to a pile designed to carry a tension load.

Figure 4:
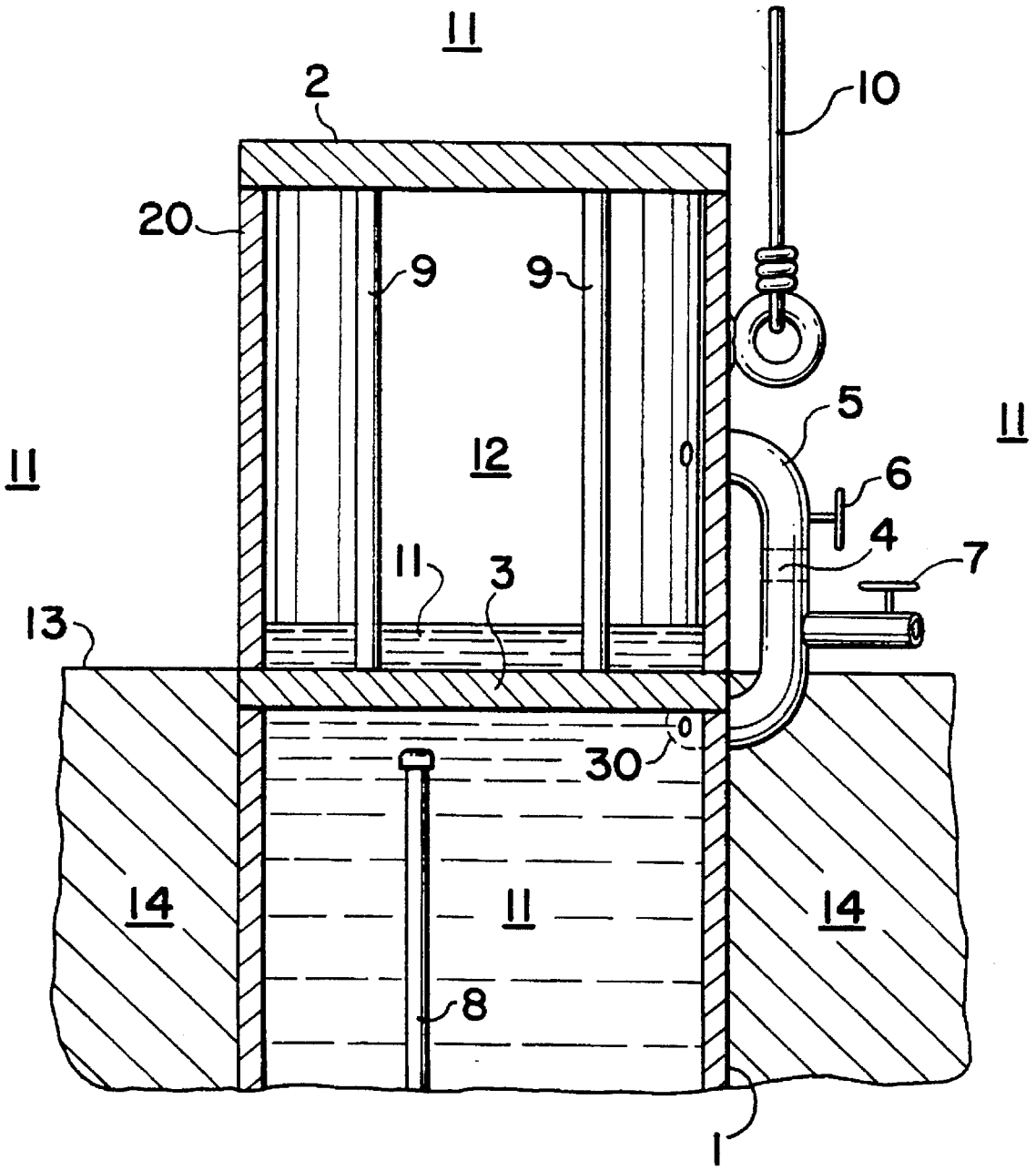
FIG. 4 is a fragmentary, vertical, sectional view, partly in elevation of the upper portion of an alternate fabrication method of a pipe pile assembly that also shows a section of the conduit made of resilient material, air cushioning apparatus and optional reinforcing posts.

In deep water, this process will subject this pile assembly to a large compressive stress after the pile is driven and its tension capacity has been increased. The pile should be structurally designed to resist this compressive stress. One obvious recommendation would be a vertical post or posts 9 in the air chamber 12 as shown in FIG. 4. But also it should be kept in mind that that portion of the driven pile directly below the partition 3 has an internal pressure that is only a little higher than the pressure in the air chamber 12.

A way to counter compressive hydrostatic pressure in very deep water is to pressurize the air chamber 12 through the conduit 5 at the pile fabrication yard before the connecting valve 6 is closed. The amount of this pressurization would be the difference between hydrostatic pressure at the intended installation depth and the pressure that the pile can structurally withstand safely. This would partially counterbalance the compressive hydrostatic pressure in very deep water both above and below the partition 3 after the connecting valve 6 is opened. In this way, only a portion of the available hydrostatic pressure on top of the pile cap 2 would increase the driven pile's tension capacity.

This pile design and process are not restricted to piles that carry vertical tension loads like those directly below a tension leg platform. This pile design and process can also inexpensively increase the pullout resistance of guy line piles subjected to horizontal and near horizontal loads. If such piles are structurally sound and cannot be pulled out of the ocean floor, they can bend but they cannot fail.

When in the closed position, it is important that the connecting valve 6 and the exhaust valve 7 do not leak. Valve redundancy is cheap insurance. Also, it is recommended that the conduit 5 should have a small inside diameter to more easily resist compressive stress. Whether it takes ten seconds or ten minutes for the conduit 5 to perform its function is of little consequence. A screen 30 shown in FIG. 4 could be placed over the entrance to the conduit 5 to keep out extraneous aquatic matter.

It is important to minimize vibrations caused by the pile driving hammer. A long small diameter vertical pipe 8 shown in FIG. 4 closed at the top and open at the bottom and welded to the inside wall of the pipe pile below the partition 3 would trap air when the pile is upended at the ocean surface. This air would be compressed as the pile is lowered to the ocean floor but it would still provide an air cushion that could dampen vibration.

Figure 2:
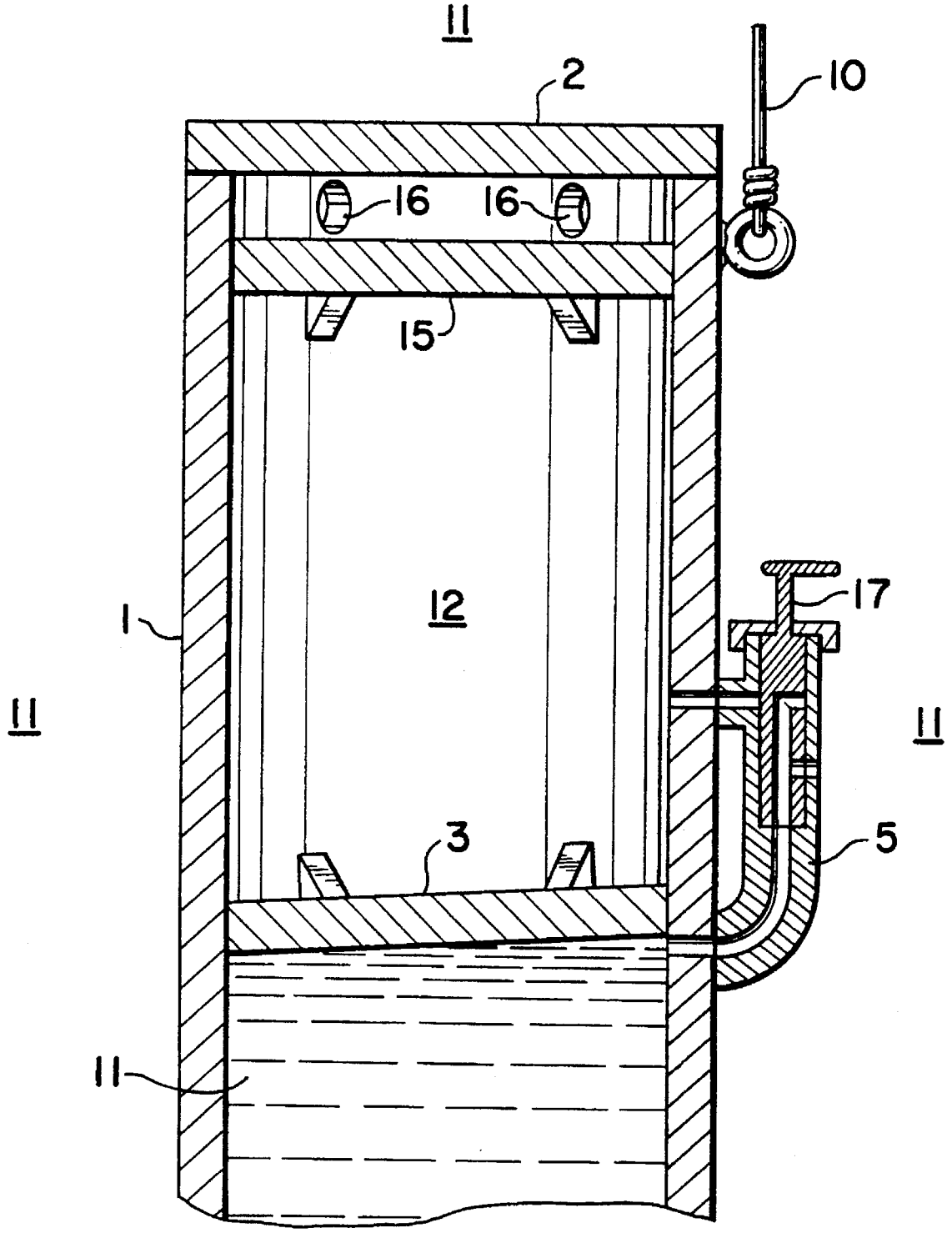
FIG. 2 is a fragmentary, vertical, sectional view, partly in elevation of the upper portion of a second embodiment of a pile assembly of the present invention while the pile is just below the ocean surface.
Figure 3:
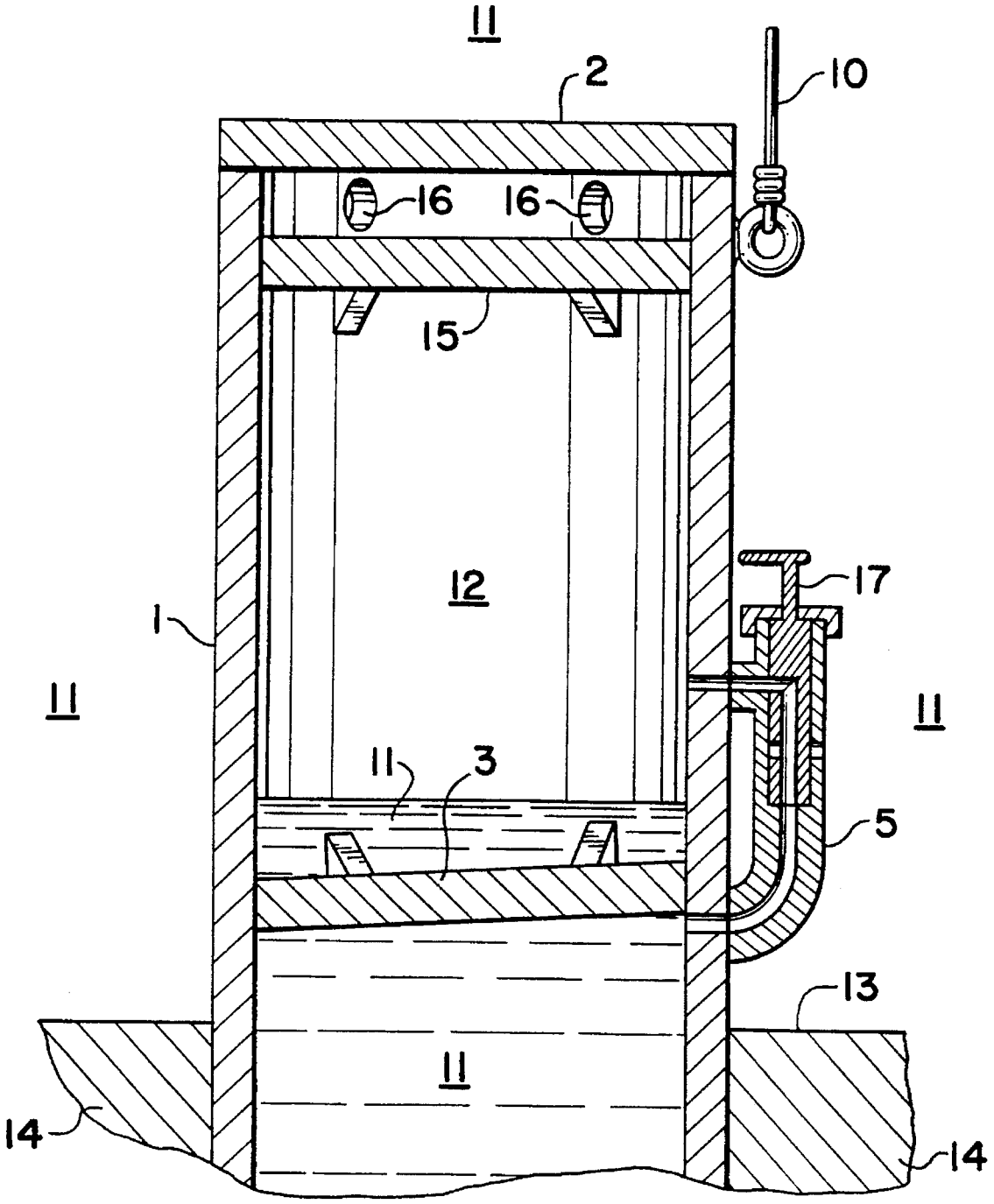
FIG. 3 is a fragmentary, vertical, sectional view, partly in elevation of the upper portion of the second embodiment of a pile assembly of the present invention that has been driven into the ocean floor.

Shown in FIGS. 2 and 3 is a second embodiment of the present invention that has only one moving part. The connecting valve 6 and exhaust valve 7 and their functions are replaced by a directional valve 17 incorporated within the conduit 5. FIG. 2 shows the position of handle of the directional valve pointing away from pile when the pile assembly is just below the ocean surface expelling trapped air. The directional valve 17 is then turned ninety degrees in either direction by a diver to a closed position (not shown) which isolates the pile's interior below the partition 3 from the air chamber 12.

The pile assembly is then lowered to the ocean floor 13 and driven. After the waiting period is over, the handle of the directional valve is turned another ninety degrees by a tethered remote operating vehicle and now points at the pile as shown in FIG. 3. Sea water 11 from below the partition 3 expands into the air chamber 12 and the driven pile's tension capacity has been increased. Directional valves come in many shapes and functional abilities. The directional valve 17 shown in FIGS. 2 and 3 is just one example of a directional valve that could be used with this system.

Figure 5:
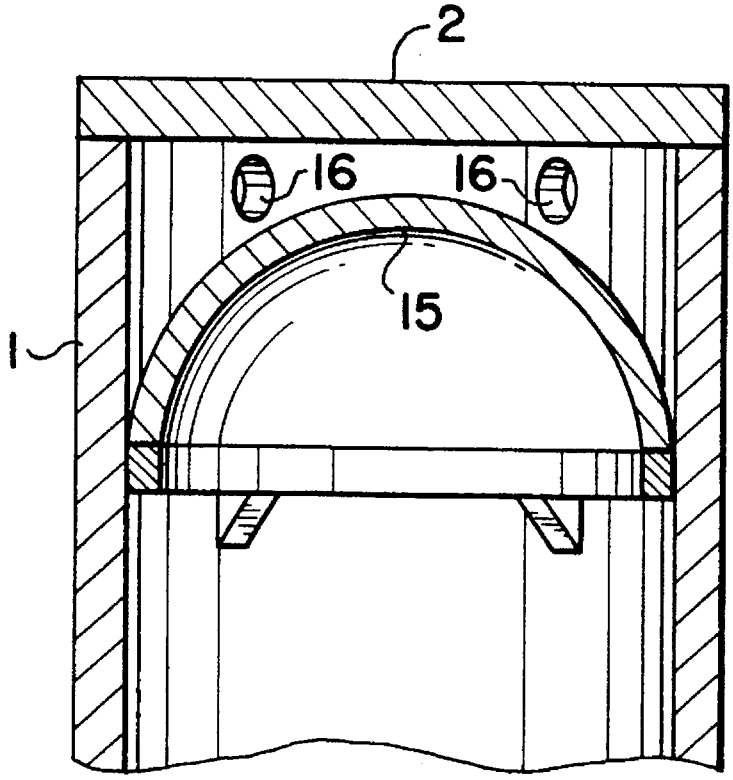
FIG. 5 is a fragmentary, vertical, sectional view, partly in elevation of the upper portion of a pipe pile assembly showing a hemispherical false pipe cap.

If it is thought that the impact of the pile driving hammer could damage the pile cap 2 and compromise the integrity and air tightness of the air chamber 12, a second or false pile cap 15 could be installed below the normal pile cap 2. This false pile cap 15 could be thick and flat as shown in FIGS. 2 and 3 or thinner and hemispherical as shown in FIG. 5. Holes 16 drilled in the pipe pile 1 between the two pile caps would subject the lower or false pile cap 15 to the local hydrostatic pressure. It is this downward force on top of the false pile cap 15 that would increase the tension capacity of the driven pile upon completion of this process.

When relieved of compressive stress, air being a gas will expand to the limits of its new confinement while water being a liquid will not. For this reason, it is very important to this process that almost all of the air trapped below the partition 3 when the pile is upended be expelled from the pile before the pile is lowered to the ocean floor. FIGS. 2 and 3 show a partition 3 slightly tilted from the horizontal position with the lower entrance to the conduit 5 under the highest part of the bottom of the tilted partition 3. This arrangement would assist in the expulsion of essentially all of the air trapped below the partition 3.

In another fabrication method of the pile assembly depicted in FIG. 4, end plates forming the partition 3 and the pile cap 2 are attached to a short pipe pile section 20. The end plates have diameters equal to the outside diameter of the pipe pile. They could be flash-butt welded to the short pipe pile section. The partition end of this short closed pipe pile section is then attached to the main pipe pile. The rest of the fabrication of the pile assembly is as previously described.

When the pile driving hammer hits the pile cap 2, a compression wave is created that migrates down through the walls of the pipe pile. To anticipate and alleviate any structurally degrading effects to the conduit 5 caused by the propagation of the above compression wave, the entire length of conduit 5 could be welded to the pile. Alternately, a conduit section 4 could be made of a nonmetallic resilient material as shown in FIG. 4. As recommended previously, the conduit 5 does not have to have a large inside diameter. It is easier to make a spirally reinforced resilient conduit section 4 that will resist hydrostatic pressure if the inside diameter is small.

FIG. 6 shows another method by which the pile assembly can be fabricated. The prefabricated air chamber 12 has an outside diameter that is slightly smaller than the inside diameter of the pipe pile 1. It is installed within the pipe pile 1 in any intermediate location. The pipe pile 1 itself is not part of the air chamber 12. With this construction method, the air chamber 12 would be somewhat insulated from the previously mentioned compression wave that moves down the pipe pile 1 with every hammer blow. The top and bottom of the annulus space between the outside of the air chamber 12 and the inside wall of the pipe pile 1 would be blocked to hold the air chamber in place and prevent any sea water 11 from flowing through the annulus space. A mastic material that hardens could be injected into annulus space.

It was stated earlier that the upward pull of the pile's anchor cable 10 must overcome the hydrostatic pressure on top of the pile cap 2 before any upward stress is applied to the clay soils adjacent to the pile. In other words, the hydrostatic pressure is loaded first. Then the clay soils through which the pile is driven carry what remains of the tension load.

Normal pipe piles anchoring floating tension leg platforms are subjected to cyclic tension loads caused by repetitive water surface phenomena such as ocean swells and wind gusts. Offshore oil fields in deep water have life expectancies of twenty to thirty years. The long-term effects of these cyclic tension loads on the clay soils at the pile-soil interface has yet to be demonstrated. The pile tension capacity provided by hydrostatic pressure on top of the pile cap 2 will not be degraded by cyclic tension loads.

Figure 7:
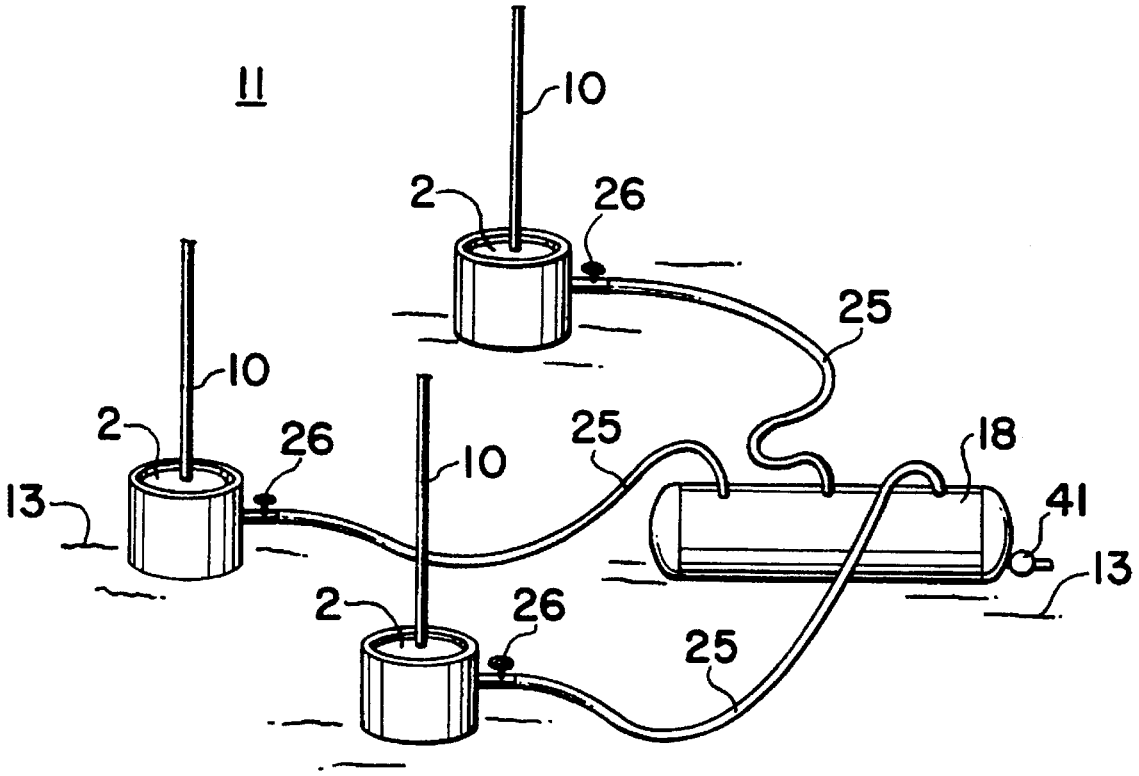
FIG. 7 is an oblique view of the ocean floor showing multiple driven piles connected to an enclosed space by external conduits.

All that is needed for this process to operate is the creation of a structurally sound enclosed space of sufficient volume at the ocean floor. As shown in FIG. 7 this enclosed space 18 could be outside of the pile and would contain air at near surface atmospheric pressure. It would be connected through an external conduit 25 to a control valve 26 which is connected to the pile interior just below the pile cap 2. In FIG. 7, the pile cap 2 has been recessed into the pile to protect it from the pile driving hammer. The control valve 26 performs the functions of both the connecting valve 6 and the exhaust valve 7 and no partition 3 is needed within the pile. The water within the pile just needs a space into which it can expand and thereby increase the tension capacity of the pile. One such enclosed space 18 of sufficient volume could serve more than one pile and the external conduit connections could be made after the piles are driven. One enclosed space 18 could replace a dozen partitions and serve all the piles under a tension leg platform.

With this third embodiment of the invention, a section of pipe pile closed at both ends could be used as an enclosed space. If needed, a second enclosed space containing surface atmospheric air pressure (not shown) could be lowered to the ocean floor and connected to the original enclosed space 18.

As with the air chamber, the enclosed space can be pressurized at the fabrication yard to a predetermined pressure. In very deep water, this would protect the structural integrity of the pile and the enclosed space while using only part of the available hydrostatic pressure to increase the tension capacity of the piles.

With this third embodiment of the present invention, the only required modifications to an ordinary pipe pile would be a hole drilled in the pile just below the pile cap and a valve welded to the pile over the hole. That is neither complicated nor expensive. In fact, it is almost inconsequential in time, money and materials.

Some clay soils in deep water are slightly permeable. If the pipe piles anchoring a tension leg platform and connected to an enclosed space 18 were driven into such clay soils, a positive displacement pump 41 could be connected to the enclosed space 18 as shown in FIG. 7. The pump 41 would receive its power from the surface platform. The pump 41 would be designed to start by a float or an electrical circuit being closed by rising salt water within the enclosed space 18. A one-way ball check valve (not shown) between the pump 41 and the enclosed space 18 would seal the enclosed space 18 when the pump was not running.

The pump 41 would keep the pressure within the enclosed space 18 near surface atmospheric air pressure by expelling the slow migration of ground water that enters the pipe piles and ends up inside the enclosed space 18. The anchor piles would maintain their added tension capacity.

The accurate determination of the tension capacity of a pile driven into the ocean floor can be a somewhat inexact science. Consequently, pile foundation designs for offshore floating platforms incorporate a significant factor of safety. On a per unit basis such as cost per ton of tension capacity, a ton of tension capacity added for reasons of safety would normally cost just as much as a ton of required operational tension capacity. But with the additional pile tension capacity provided by the pile assembly and process described herein, a large proportion of the factor of safety pile tension capacity can be obtained very economically with this invention.

While the preceding description contains many specificities, they should not be construed as limitations on the scope of the invention but rather as an exemplification of preferred examples thereof. Accordingly, the scope of the invention should be determined not by the examples described, but by the appended claims and their legal equivalents. Various changes in shapes, size, arrangement of parts, composition and methods of use and operation may be resorted to without departing from the spirit of the invention or scope of the subjoined claims.

I claim:

1. A pile assembling comprising:

a cylindrical pipe pile;

a pile cap attached at the upper end of said pipe pile and forming a continuous member with said pipe pile;

a partition within said pipe pile and forming a continuous member with said pipe pile;

conduit means for allowing the flow of liquid from the interior of said pile assembly below said partition to the interior of said pile assembly above said partition;

valve means in said conduit means for temporarily isolating the interior of said pile assembly above said partition from the interior of said pile assembly below said partition; and attachment means for attaching the upper end of said pile assembly to an anchor cable.

2. The pile assembly of claim 1, wherein said pile assembly is provided with exhaust valve means for the removal of gases from said pile assembly below said partition.

3. The pile assembly of claim 2, wherein directional valve means in said conduit means performs the function of both said valve means and said exhaust valve means.

4. The pile assembly of claim 1, wherein said pile assembly is provided with multiple pile caps.

5. The pile assembly of claim 4, wherein said pile assembly is provided with a pile cap of hemispherical shape.

6. The pile assembly of claim 1, wherein said partition is tilted from the horizontal position.

7. The pile assembly of claim 1, wherein said pile assembly is provided with a post between said partition and said pile cap.

8. The pile assembly of claim 1, wherein said pile assembly is provided with a plurality of posts between said partition and said pile cap.

9. The pile assembly of claim 1, wherein said pile assembly is provided with air cushion means to dampen vibrations, within said pile assembly.

10. The pile assembly of claim 1, wherein said partition has a diameter that is equal to the outside diameter of said pile assembly.

11. The pile assembly of claim 1, wherein a portion of said conduit means is made of a resilient material.

12. The pile assembly of claim 1, wherein said partition has a diameter that is smaller than the inside diameter of said pile assembly.

13. The pile assembly of claim 1, wherein said pile cap is recessed into said pile assembly.

14. A process of increasing the tension capacity of said pile assembly that has been installed in the ocean floor comprising the steps of:

(1) waiting for a period of time sufficient to allow disturbed and remolded clay soils adjacent to the pile's exterior to set-up and regain their full shear strength; and (2) creating a fluid connection through conduit means for allowing the flow of liquids from the interior of said pile assembly from below a partition within said pile assembly and forming a continuous member with said pile assembly to the interior of said pile assembly above said partition by opening valve means in said conduit means to allow the flow of said liquids through said conduit means thereby causing hydrostatic pressure on top of said pile assembly to increase the tension capacity of said pile assembly.

15. The process of claim 14, wherein the capacity of said pile assembly to resist horizontal and near horizontal tension loads is increased.

16. The process of claim 14, wherein the interior of said pile assembly above said partition is pressurized prior to installation of said pile assembly to a pressure equal to the difference between the hydrostatic pressure at the intended pile installation depth and the pressure that the pile can structurally withstand safely.

17. The process of claim 14, wherein said process is monitored by listening means attached to said conduit means to hear the flow of water through said conduit means.

18. The process of claim 14, wherein retention means are used to confine water within said pile assembly during installation of said pile assembly to prevent the development of any significant soil core within said pile assembly.

19. An alternate process of increasing the tension capacity of said pile assembly comprising the steps of:

(1) after said pile assembly has been installed in the ocean floor, waiting for a period of time sufficient to allow disturbed and remolded clay soils adjacent to the pile's exterior to set-up and retain their full shear strength;

(2) connecting one end of external conduit means which will allow the flow of liquids from the interior of said pile assembly to control valve means attached to the exterior of said pile assembly and which controls the flow of said liquids from the interior of said pile assembly and connecting the other end of said external conduit means to means defining an enclosed space which will receive said liquids; and (3) creating a fluid connection through said external conduit means between the interior of said pile assembly and the interior of said means defining an enclosed space by opening said control valve means thereby causing hydrostatic pressure on top of said pile assembly to increase the tension capacity of said pile assembly.

20. The process of claim 19, wherein a plurality of said pile assembly interiors are connected to one said means defining an enclosed space by a plurality of said external conduit means.

21. The process of claim 19, wherein more than one said means defining an enclosed space are utilized.

22. The process of claim 19, wherein the interior of said means defining an enclosed space is pressurized prior to installation of said means defining an enclosed space to a pressure equal to the difference between the hydrostatic pressure at the intended pile installation depth and the pressure that said means defining an enclosed space and said pile assembly can structurally withstand safety.

23. The process of claim 19, wherein pump means attached to said means defining an enclosed space periodically expels water from the interior of said means defining an enclosed space to keep the pressure within said means defining an enclosed space at or near surface atmospheric air pressure.

* * * * *